US007591496B1

(12) United States Patent
De Beck

(10) Patent No.: US 7,591,496 B1
(45) Date of Patent: Sep. 22, 2009

(54) UP-RIGHT CARRY-OUT

(76) Inventor: Thomas D. De Beck, Suite 1102, 271 Madison Ave., N. Y., NY (US) 10016

( * ) Notice: Subject to any disclaimer, the term of this patent is extended or adjusted under 35 U.S.C. 154(b) by 241 days.

(21) Appl. No.: 10/986,787

(22) Filed: Nov. 15, 2004

(51) Int. Cl.
*A45F 5/00* (2006.01)

(52) U.S. Cl. ..... 294/152

(58) Field of Classification Search ..... 294/152, 294/137, 154; 383/6, 10, 38; 206/77.1, 189, 206/117.27
See application file for complete search history.

(56) References Cited

U.S. PATENT DOCUMENTS

| | | | | | |
|---|---|---|---|---|---|
| 1,448,866 | A * | 3/1923 | Redoute | 294/159 |
| 1,559,046 | A * | 10/1925 | McLeran | 294/152 |
| 1,627,583 | A | 5/1927 | Thum | |
| 1,683,678 | A | 9/1928 | Kitterman et al. | |
| 1,971,322 | A | 8/1934 | Miller | |
| 2,300,874 | A | 11/1942 | De Ferrari | |
| 3,337,046 | A | 8/1967 | Roy et al. | |
| 4,337,812 | A * | 7/1982 | Trinkner | 383/6 |
| 4,712,673 | A * | 12/1987 | Moore | 206/232 |
| 5,118,033 | A * | 6/1992 | Kula | 229/115 |
| 5,180,894 | A * | 1/1993 | Quick et al. | 219/730 |
| 5,232,258 | A * | 8/1993 | Rossi | 294/152 |
| 5,251,945 | A * | 10/1993 | Stoops | 294/152 |
| 5,524,949 | A | 6/1996 | Mooney | |
| 5,709,913 | A * | 1/1998 | Andersen et al. | 428/34.5 |
| 5,961,043 | A * | 10/1999 | Samuelson et al. | 239/54 |
| 6,036,085 | A * | 3/2000 | Tsao | 229/117.14 |
| 6,298,992 | B1 | 10/2001 | Tsao | |
| D462,904 | S | 9/2002 | Mellon et al. | |
| 6,749,064 | B1 * | 6/2004 | Alrey | 206/457 |
| 2002/0060167 | A1 * | 5/2002 | Nichols et al. | 206/440 |
| 2003/0106899 | A1 * | 6/2003 | Langen | 220/912 |

FOREIGN PATENT DOCUMENTS

| | | | |
|---|---|---|---|
| EP | 452167 | * 10/1991 | 383/38 |

* cited by examiner

*Primary Examiner*—Paul T Chin

(57) ABSTRACT

A uniquely designed "sling type" container carrier which can be made from a variety of materials including paper, plastic, cloth or other suitable material. As noted above, it has a "sling type" design with a pocket positioned centrally on the "sling" in such a manner that when the pocket is filled with a product, i.e., a cake, pie, pizza or fast food container of food, the lengths of the two opposite sides of the sling are equal and serve to engage the opposite ends of the pocket and securely hold the container therein. Each end of the sling is provided with a finger cut-out which, when placed in close proximity with each other, serve as carrying handles, thus allowing a product that has been placed within the pocket, to be carried in an up-right position.

2 Claims, 3 Drawing Sheets

UP-RIGHT CARRY-OUT

BACKGROUND OF THE INVENTION

We have all at one time or another, experienced the problem of leaving our local bakery with our favorite decorated cake or lemon meringue pie placed in a conventional grocery bag and upon arrival at home find that during transit, the meringue of the pie has become dislodged from the top of the pie or the icing of the cake has become mashed due to the cake container falling over on its side and mashing the icing.

The most basic purpose of the Up-Right Carry-Out is to provide a uniquely designed carrier which can be made from a variety of materials and used to carry cakes and pies in an "upright" position once they have been placed in their respective containers. It also finds significant use in the "fast food" industry where it is desirable to keep the food within the various shaped containers separated. For example, a stop at a fast food chicken carry-out could readily result in a Styrofoam compartmented container having separate pockets or recessed areas for the chicken, mashed potatoes, coleslaw and a muffin. Although the Styrofoam container is compartmented and includes a closing lid and is placed in a conventional paper or plastic bag, there is nothing that will insure that upon arrival at home that the respective items are not co-mingled and inter-mixed with one another due to spilling over into adjacent compartments during the travel home.

This one example relating to a fast food carryout is similarly experienced and repeated daily at the hamburger carry-out, the pizza shop, bakery and many similar situations where it is desirable to maintain certain food products in a horizontal position during transit to ensure the items therein are kept stable and horizontal while being transported, thus helping to reduce or eliminate leaks or spills of the products therein.

DESCRIPTION OF THE INVENTION

The invention is a uniquely designed "sling type" container carrier which can be made from a variety of materials including paper, plastic, cloth or other suitable material. As noted above, it has "sling type" design with a pocket positioned centrally on the "sling" in such a manner that when the pocket is filled with a product, i.e., a cake, pie, pizza or fast food container of food, the lengths of the two opposite sides of the sling are substantially equal and serve to engage the opposite ends of the pocket and securely hold the container therein.

Each end of the sling is provided with a cut-out which, when each are placed in close proximity with each other, serves as carrying handles, thus allowing a product that has been placed within the pocket, to be carried in an up-right manner.

As noted above, this carrier has many uses in that it can successfully be utilized for a variety of products, and as such, the pockets can be shaped in various sizes, lengths, widths and depths. The pocket can be square, round, rectangular, triangular or have an angular shape to conform to a particular product that it is intended to be used to carry in an up-right position.

DISCUSSION OF THE PRIOR ART

A manual search of the pertinent classes and subclasses was conducted in the files of the U.S. Patent Office and revealed the following patents U.S. D462,904—Issued to Mellon et al on Sep. 17, 2002—discloses a design patent wherein a container is inserted into a preformed carrier with handles for carrying prepared food.

U.S. Pat. No. 1,627,583—Issued to Thum on May 10, 1927—discloses an ice cream cone carrier that includes a pair of shelf elements 23 and 24 with openings 32 and 33 for receiving the cones 10 of an ice cream cone and is adhesively bonded to the interior surface of the rectangular sheet 15.

U.S. Pat. No. 1,683,678—Issued to Kitterman et al on Sep. 11, 1928—discloses a utility bag 5 that is cut to provide side flaps 6 and end flaps 7, the latter of which includes a draw string 9. The outer ends of the side flaps 6 are provided with mating members of snap fasteners 10 At the center of the bag is provided a flexible casing 12 that can include items such as soap, wash cloth, toilet articles and the like.

U.S. Pat. No. 1,971,322—Issued to Miller on Aug. 21, 1934—discloses "a sling sak" for carrying firewood. The carrier comprises a flattened tube 1 composed of flexible material, preferably strong and tough fiber paper and includes a handle at opposite ends of the folded tube.

U.S. Pat. No. 2,300,874—Issued to Ferrari on Nov. 3, 1942—discloses a carrying case adaptable for a plurality of forms including a florist box, candy box, shipping containers, hat or shoe boxes and the like. In the preferred form, an elongated blank having a pair of flaps extending from opposite sides and score lines with interlocking means on the flaps for providing an open box in the center thereof. Although it is disclosed as useful for carrying a cake or pie, there is no structure shown that will protect the cake or pie during transit.

U.S. Pat. No. 3,337,046—Issued to Roy et al on Aug. 22, 1967—discloses a carrier made of a single sheet of blank material such as reinforced paper. It includes end handle flaps a1, a1 that are provided with bottle overlay flaps a5 and a6 for engaging the necks of a bottle and retain them in a horizontal position during.

U.S. Pat. No. 4,712,673—Issued to Moore on Dec. 15, 1987—discloses a combination food carrier and amusement device comprising first and second panels having a removable bag member and a book secured to the inner surfaces thereof. First and second panels are provided with removable handle portions that enable the device to transport food items retained in a bag member. The bag member and the handle portions are disposable so that the device remains as a unique amusement device and book.

U.S. Pat. No. 5,232,258—Issued to Rossi on Aug. 3, 1993—discloses a handle assembly for an article carrier. The carrier includes a pair of flexible panel members 12 and 14 that are placed at right angles to each other. Panel member 14 includes a pair of cut-out areas forming a handle. A pocket 22 is used to receive a rigid base member 16 to serve as a base support member for supporting a food carrier 331 that is placed over rigid base member 16. Opposite ends of panel member 12 are tied into a knot to secure container 31 in place during transit.

U.S. Pat. No. 5,524,949—Issued to Mooney on Jun. 11, 1996—discloses a carrier for use by a person for carrying a load which is to be carried in an essentially horizontal position. The carrier 1 is in the form of a bag, which includes handles 9 and a plurality of openings in the lower end of the bag for receiving corners 7 of a container therein.

U.S. Pat. No. 6,298,992—Issued to Tsao on Oct. 9, 2001—discloses a foldable food and beverage carrying device that includes a base member 11 having an opening 10 formed therein for inserting a food container 2. A pair of handle members 12 are formed on opposite ends of the base member 11 and are interlockable to serve as a handle for carrying purposes.

As can be seen from a review of this known prior art, there are a variety of carrier devices that include handles and are utilized for carrying a variety of devices, however, none of the above cited art discloses a carrier that includes a shaped pocket that is positioned on the interior surface of the carrier for receiving a food product in a container and maintains the food product in a horizontal position during transit thus preventing spilling or mashing of the product within the container.

OBJECTS OF THE INVENTION

An object of the invention is to provide a carrier for food products in containers that will maintain the food products in a horizontal position while being carried.

A further object of the invention is to provide a carrier that is useful in carrying a variety of fast food products and maintain them in their respective positions while in transit.

A still further object of the invention is to provide a fast food carrier that can be made of either plastic, paper, or other suitable inexpensive material.

Yet another object of the invention is to provide a carrier that includes a pocket for holding the fast food in a horizontal position and the pocket can be either glued or heat welded to the carrier.

Another object of the invention is to provide another embodiment of a fast food carrier that is a one piece construction and is disposable and inexpensive to manufacture.

A further object of the invention is to provide a fast food carrier having a pair of handle portions and a pocket formed thereon by a three-sided weld with a fourth open side for receiving a container that is retained therein by one of the handle portions.

Yet another object of the invention is to provide a fast food carrier that is easy to use and the container held therein is secured by the carrying handles, which keep it upright and stable.

A further object of the invention is to provide a fast food carrier wherein the container secured therein is locked in place by the handles and can be readily carried with one hand.

These and other objects of the invention will become more apparent hereinafter. The instant invention will now be described with reference to the accompanying drawings wherein like reference characters designate the corresponding parts throughout the several views.

DETAILED DESCRIPTION OF THE DRAWINGS

Figure 1:
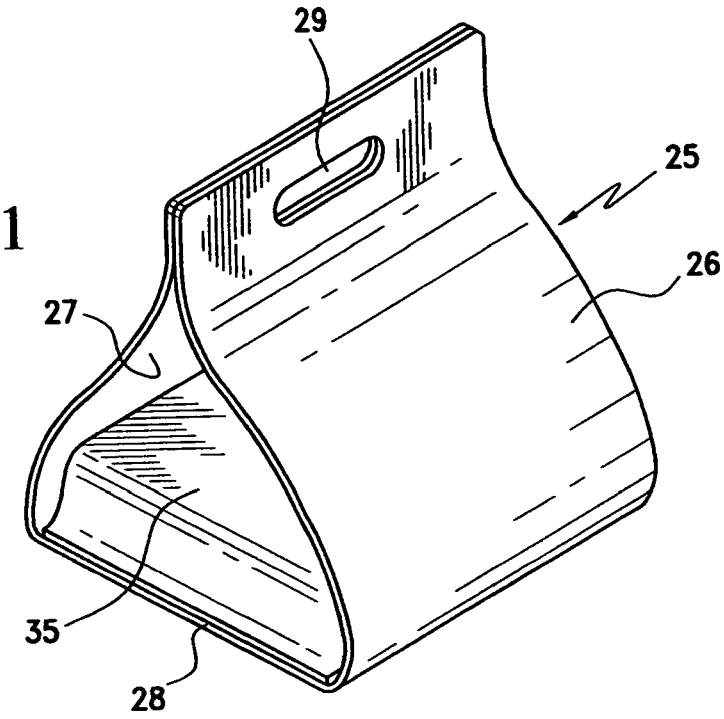
FIG. 1 is a perspective view of the novel two-piece construction carry-out carrier to illustrate the positioning of a fast food container therein while carrying food therein

Referring now to FIG. 1, there is shown the novel fast food carrier 25 which includes a pair of oppositely disposed handle members 26, 27 that extend upwards from base portion 28 and are provided with finger slots 29 to complete the handle assembly. As indicated above carrier 25 is comprised of two basic members, a sling portion, comprised of elongated handles 26, 27 and an interconnected base portion 28 and an overlying pocket 35. Base portion 28 is provided with an overlying pocket 35 that includes three closed sides with one side open for receiving a fast food container therein. The shape of pocket 35 may vary depending upon the intended use of carrier 25. For example, the shape may be square, triangular rectilinear or circular of various depths and/or heights as more clearly set forth in FIG. 3. The entire carrier may be made from a commercial grade paper where the pocket is adhesively secured to the sling portion of the carrier or alternatively, the carrier made be constructed of a plastic film as used in the grocery bag industry. In this instance, the pocket 35 would be precut to the desired dimensions and subsequently heat welded to the sling portion.

Figure 2:
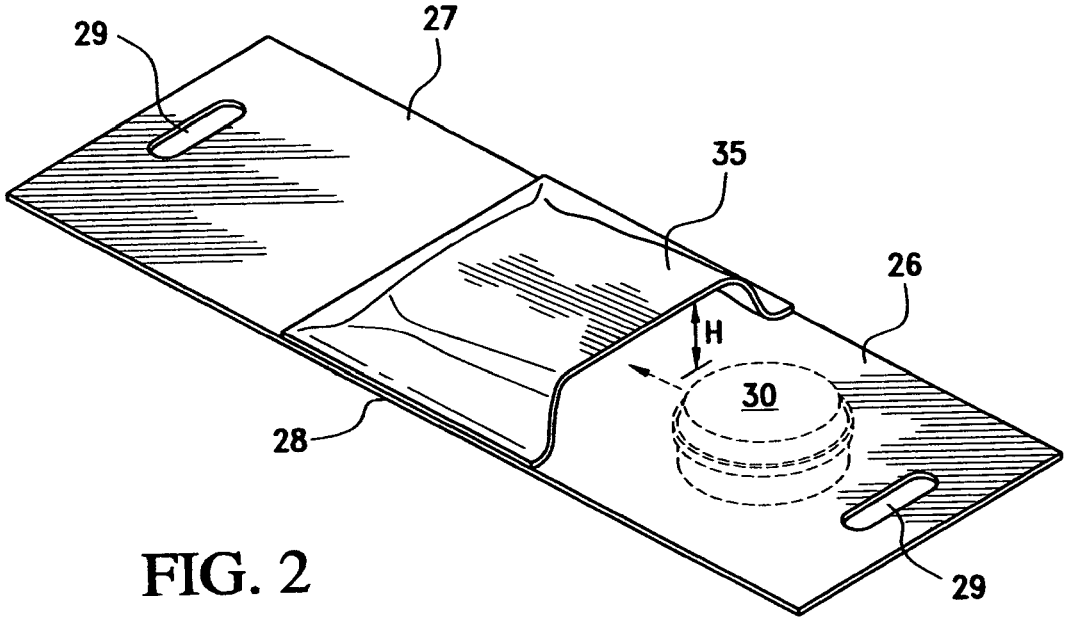
FIG. 2 is a plan view of the two-piece construction carry-out carrier in its open position for receiving a container.

FIG. 2 is a plan view of fast food up-right carrier 25, there is shown oppositely disposed handle members 26, 27 with finger openings 29 for carrying carrier 25. As shown, opposite side edges 26E and 27E each taper inward toward each other as they approach finger openings 29. Centrally positioned on carrier 25 is pocket 35. A container 30, that will readily accommodate a pie or cake, (neither shown), depending on the intended use of the novel up-right carrier, is shown about to be positioned within pocket 35. If the container 30, to be received in pocket 35 was to be used for cakes, the pocket 35 that receives the cake container would have a height "H" that would be greater than the height of a pocket that was to receive a container holding a pie therein. Of course, the diameter or width of pocket 35 is determined by the size of the cake or pie that is intended to be carried therein, it is intended that the subject carrier will be manufactured in a variety of sizes to accommodate the needs of the fast food industry.

Figure 3:
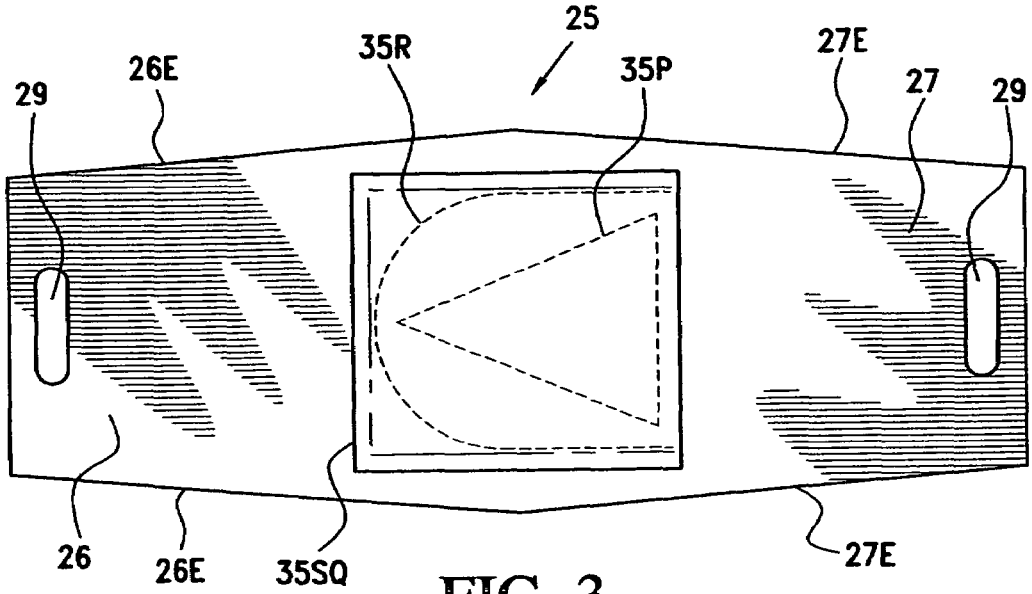
FIG. 3 is a plan view of the novel fast food carrier made of two-piece construction, illustrating three differently configured pockets in dash lines, however, only one configuration would be utilized per carrier.

FIG. 3 is a plan view somewhat similar to FIG. 2, however, the outer edges 26E and 27E are slightly tapered toward center. Additionally, there are three different configurations for pocket 35, a square bottomed pocket 35SQ, a round bottomed pocket 35R and a pie-shaped pocket 35P. These are three examples of the configuration that pocket 35 may take, it is to be noted, however, that only one of these three different shapes would be used at any given time, they are alternative configurations.

Figure 4:
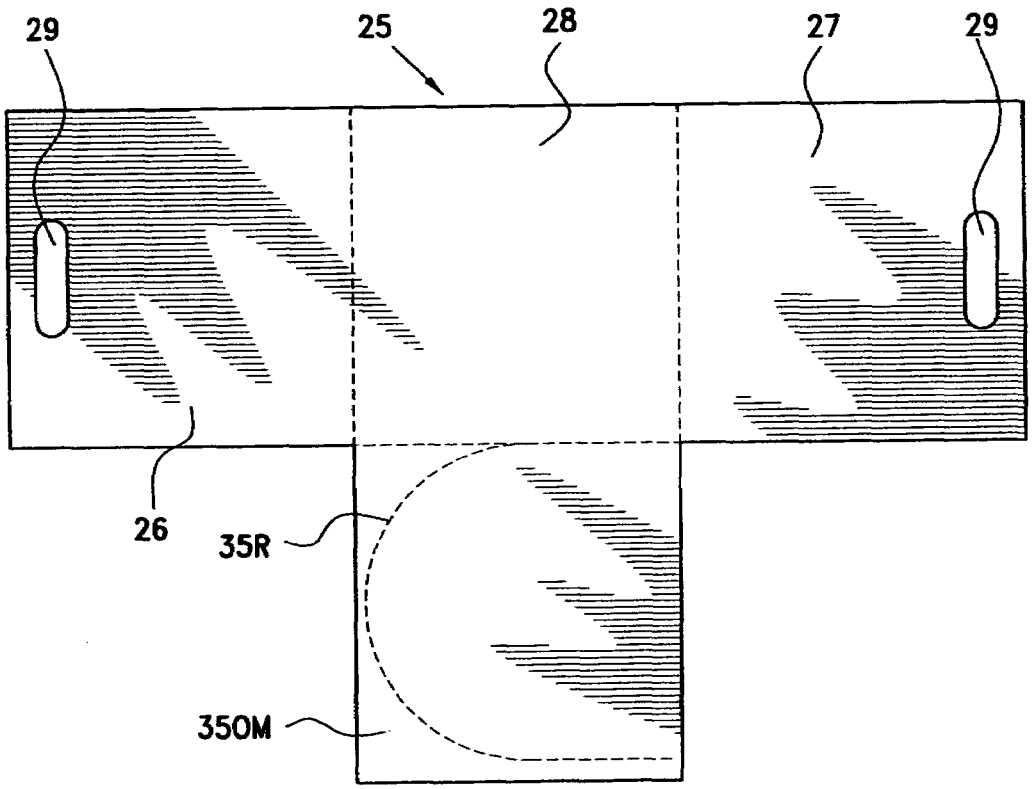
FIG. 4 is another plan view, of an alternate type of construction, wherein the pocket is integrally formed with the remainder of the carrier and subsequently overlaid.

FIG. 4 is a plan view of an alternative embodiment illustrating another way of making the pocket 35. In this embodiment, carrier 25 comprises a length of material having a pair of handle portions 26 and 27 interconnected by a base portion 28. Extending at a right angle to base portion 28 is the overlay material 350M that will form pocket 35 once it is overlaid over base portion 28 and heat welded along three sides thereof to form pocket 35. Although heat welding has just been described as the means of securing overlay 35 OM to base portion 28, this would only be the case where a plastic film was utilized to manufacture the carrier 25. If the carrier 25 were to be made of kraft paper, then pocket 35 would be attached to base portion 28 by means of a suitable adhesive applied around the periphery thereof to bond pocket 35 to the base portion of carrier 25.

Again, overlaid portion 35OM shows a dashed arcuate line 35R which represents the shape of the pocket to be formed once overlaid over base 28, however, this is merely exemplary, the shape of the pocket 35 may vary depending upon its intended use.

Figure 5:
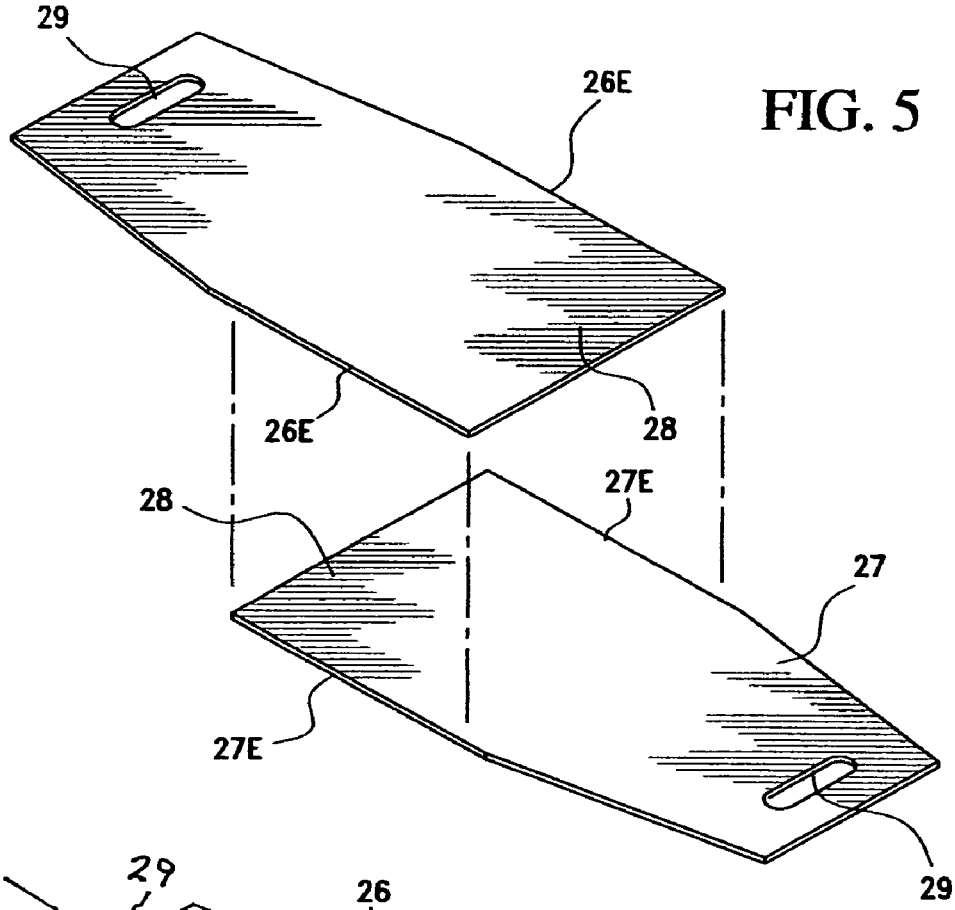
FIG. 5 is an illustration of an alternate two-piece construction carrier, illustrating the two pieces before they have been secured together to form the novel carrier.
Figure 6:
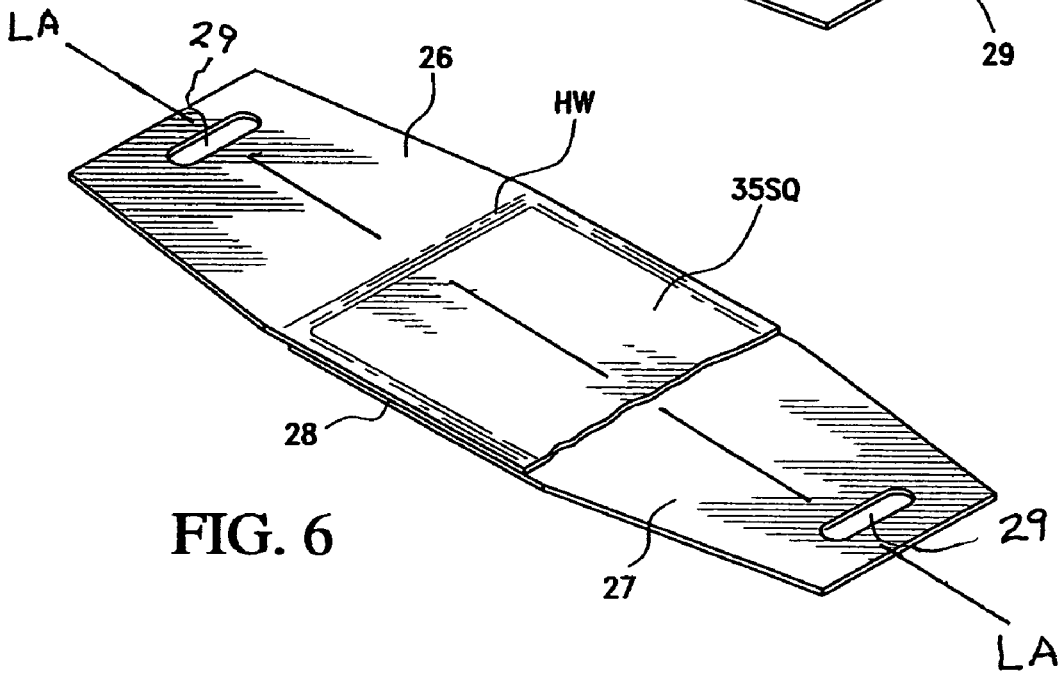
FIG. 6 is a side view illustrating the carrier of FIG. 5 after they have been joined by a three-sided peripheral heat weld.

FIG. 5 is an illustration of the embodiment utilizing a two piece construction wherein each of the handle portions 26 and 27 are separate pieces, each of which includes a base portion 28. Handle portion 26 is placed over handle portion 27 with the straight edge portions 26E overlapping straight edge portions 27E of handle portion 27, a heat weld has then applied in one of the three shapes shown, i.e. 35SQ, thus forming the pocket 35SQ, as illustrated in FIG. 6. As indicated above, the various shapes come in a variety of sizes to accommodate a wide range of products. In this embodiment, the material forming pocket 35SQ is an integral part of base portions 28 of both handle portions 26 and 27 rather than a separate element as used in the earlier embodiment of FIGS. 1, 2 and 4.

FIG. 6 is a plan view of the embodiment shown in FIG. 5 after the heat weld has been applied thus joining handle portions 26 and 27 and forming pocket 35 thereon. Additionally, there is shown in longitudinal axis LA of the device.

It is believed that a review of the subject invention would be useful at this point. It is pointed out that applicant has provided a sling-type carrier that finds application in the fast food industry and can be successfully utilized to carry and maintain the contents therein in a horizontal position, thus eliminating spillage, or intermixing of the contents. The carrier can be conveniently made of either plastic film of kraft paper and can be made in a plurality of different sized shapes. It can be made with either a separate pocket portion that is adhesively attached to the handle portion or a pocket that is formed by a heat weld directly on the handle portion, thus simplifying its production.

While the invention has been described in its preferred embodiment, it is to be understood that the words which have been used are words of description rather than words of limitation and that changes may be made within the purview of the appended claims without departing from the fill scope or spirit of the invention. Accordingly, the present invention is to be limited only by the appended claims, and not by the foregoing specification.

Having thus described my invention, I claim:

1. A carrier apparatus comprising:

a rectangular base member having a first end and a second end opposite the first end;

a first rectangular side member connected at the first end of said base member, said first rectangular side member having a first cutout handle portion formed near an outer edge of said first rectangular side member, said first cutout handle portion comprising a longitudinal opening substantially parallel to the outer edge of said first rectangular side member;

a second rectangular side member connected at the second end of said base member, said second rectangular side member having a second cutout handle portion formed near an outer edge of said second rectangular side member, said second cutout handle portion comprising a longitudinal opening substantially parallel to the outer edge of said second rectangular side member;

a pocket member having four sides with three of said sides secured to said base member and forming an opening at said fourth side having a face extending substantially perpendicular to said base member, wherein said first side member and second side member are movable with respect to said base member between a first position and a second position, said opening accessible at said first position, and further wherein at said second position said first side member directly abuts said opening, and the face of said opening remains substantially perpendicular to said base member, and further wherein at said second position said first cutout handle portion and said second cutout handle portion align to form a single opening through said first side member and said second side member; and wherein said rectangular base member and said first and second rectangular side members retain their respective shapes in said first position and said second position.

2. The carrier apparatus of claim 1 wherein said carrier apparatus is made of commercial grade paper.

* * * * *

UNITED STATES PATENT AND TRADEMARK OFFICE

CERTIFICATE OF CORRECTION

PATENT NO. : 7,591,496 B1
APPLICATION NO. : 10/986787
DATED : September 22, 2009
INVENTOR(S) : De Beck It is certified that error appears in the above-identified patent and that said Letters Patent is hereby corrected as shown below:

Column 4, line 56, delete "350M" and insert --35 OM--

Signed and Sealed this

Twelfth Day of January, 2010

David J. Kappos

David J. Kappos
*Director of the United States Patent and Trademark Office*